US005875579A

United States Patent [19]

Winzen

[11] Patent Number: 5,875,579

[45] Date of Patent: Mar. 2, 1999

[54] INDEX TAB FOR A DIVIDER SHEET

[75] Inventor: Debra Winzen, Chesterfield, Mo.

[73] Assignee: American Trading and Production Corporation, Baltimore, Md.

[21] Appl. No.: 754,435

[22] Filed: Nov. 21, 1996

[51] Int. Cl.[6] ..... G09F 23/10

[52] U.S. Cl. ..... 40/641; 40/360; 40/654.01; 283/36

[58] Field of Search ..... 40/359, 641, 654.01, 40/661, 661.08, 765, 771, 776, 360, 384, 391, 405; 283/36, 37, 38, 39, 40, 41

[56] References Cited

U.S. PATENT DOCUMENTS

| | | | |
|---|---|---|---|
| 2,193,296 | 3/1940 | Pienzak | 40/771 X |
| 3,651,591 | 3/1972 | Woodyard | 40/776 X |
| 3,816,948 | 6/1974 | Mooney et al. | 40/776 X |
| 5,388,739 | 2/1995 | Gargan | 40/661 X |

FOREIGN PATENT DOCUMENTS

| | | | |
|---|---|---|---|
| 521567 | 8/1953 | Belgium | 40/360 |
| 56685 | 7/1982 | European Pat. Off. | 40/359 |
| 1265125 | 4/1968 | Germany | 40/359 |
| 6707351 | 11/1968 | Netherlands | 40/360 |

*Primary Examiner*—Brian K. Green
*Attorney, Agent, or Firm*—Cohn, Powelll & Hind

[57] ABSTRACT

This index tab for a divider sheet or a file folder includes first and second panels and folded against each other attached to the sheet so that the tab includes a first pocket portion extending a relatively short distance outwardly from the sheet margin and a second pocket portion extending inwardly a substantially greater distance from the sheet margin. The index tab includes a closed end defined by the fold line and an open end, disposed opposite the closed end, the open end receiving an insert which may extend substantially the full length of the index tab.

1 Claim, 2 Drawing Sheets

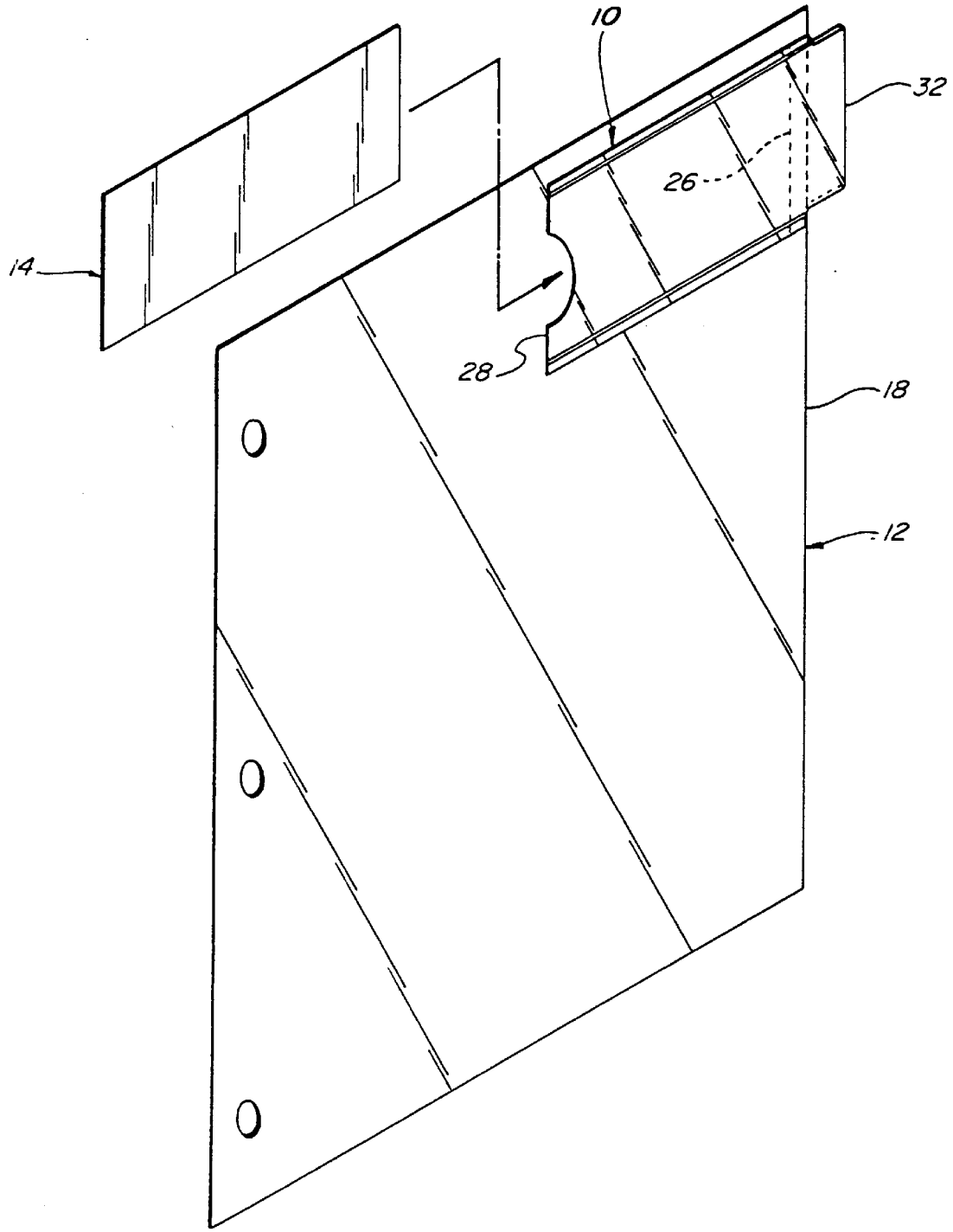
10
32
26
14
28
18
12

INDEX TAB FOR A DIVIDER SHEET

BACKGROUND OF THE INVENTION

This invention relates generally to index tabs attachable to divider sheets, file folders, and the like, and particularly to an index tab which provides an insert that is easily installed, securely retained and, in addition, provides an extended indicia bearing area.

Divider sheets of the type used to separate the contents of a loose leaf binder into sections are commonly provided with index tabs to indicate the section contents. File folders, or the hanging hooked-end carriers which hold the folders, are similarly commonly provided with index tabs to identify the contents of the file folders.

Typically, the index tabs may include a double strip of material which include an inner portion overlapping the margin of the divider sheet or one of the panels of the file folder, and an elongate outer portion disposed parallel to the sheet margin and having open ends receiving an elongate and relatively narrow insert.

While the above index tabs work reasonably well for their intended purpose they have the disadvantage that the inserts are rather difficult to install and provide a relatively small area for identifying indicia. In addition, the inserts can slip out of the index tab at the bottom end of the tab and are often difficult to emplace.

Other less expensive index tabs are also common. These are unitarily formed with the divider sheet or file folder but suffer the disadvantage that the indicia bearing portion lacks the capability of removal and replacement.

This invention overcomes these and other problems in a manner not revealed in the known prior art.

SUMMARY OF THE INVENTION

This index tab system is suitable for divider sheets and file folders. It has the advantage that the insert is easy to install and the tendency for the insert to be removed inadvertently under the influence of gravity when a divider is in a vertical orientation, is avoided. In addition, it provides an insert having an extended indicia bearing area.

This index tab for a divider sheet, a file folder, or the like, is attached to the sheet and includes interconnected first and second panels the panels cooperating to provide a first pocket portion extending outwardly of the sheet margin and having a closed end, and at least the first panel extending inwardly of the sheet margin to, at least in part, provide a second pocket portion having an insert-receiving open end.

It is an aspect of this invention to provide that the second pocket portion extends inwardly from the margin a substantially greater distance than the first pocket portion extends outwardly from said margin.

It is another aspect of this invention to provide that the index tab first and second panels are continuously formed from a blank and yet another aspect that the blank includes a fold line and is re-entrantly formed about the fold line to define the closed end of the first pocket portion.

It is still another aspect of this invention to provide that the first panel is attached to one side of the sheet and the second panel is attached to the other side of the sheet.

It is an aspect of this invention to provide that the index tab panels and the sheet are formed from heat-sealable plastic and the panels are heat-sealed to the sheet.

It is another aspect of this invention to provide that the first panel cooperates with the sheet to define the second pocket portion extending inwardly of the margin.

It is still another aspect of this invention to provide that an insert is provided having a length substantially coextensive with the combined pocket portions.

It is yet another aspect of this invention to provide that the blank is substantially rectangular having a narrowed portion defining the pocket portion extending outwardly of the margin.

It is another aspect of this invention to provide that the first panel is heat-sealed to the one side of the sheet by lengthwise extending heat sealing means and the second panel is heat-sealed to the other side of the sheet by heat-sealing means extending transversely of the first panel heat-sealing means.

This index tab system is relatively simple and inexpensive to manufacture, easy to use and very effective for its intended purpose.

BRIEF DESCRIPTION OF THE DRAWINGS

FIG. 2 is an enlarged, fragmentary elevational view of the sheet and index tab with the insert in place;

FIG. 5 is an elevational view of the tab blank;

DESCRIPTION OF THE PREFERRED EMBODIMENT

Figure 1:
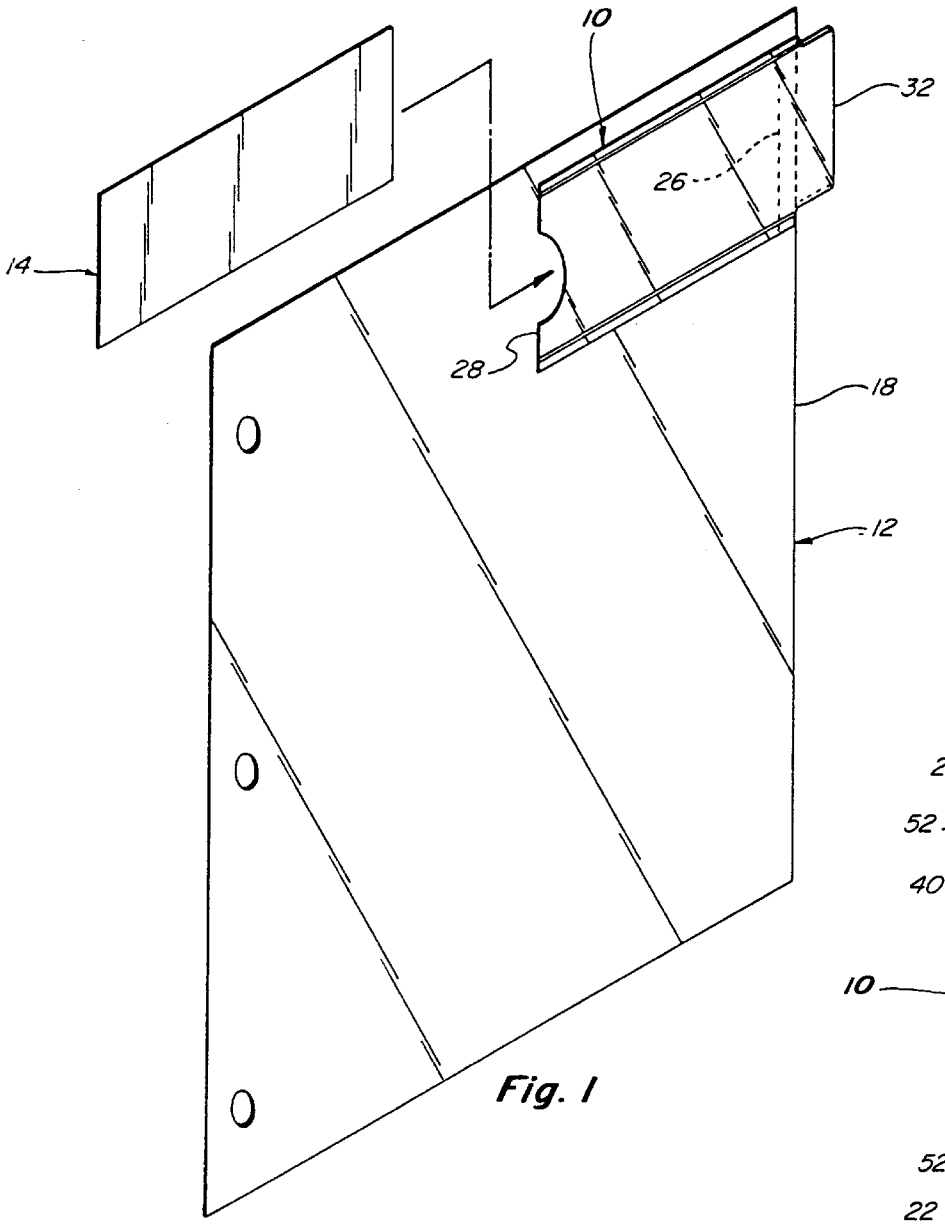
FIG. 1 is a perspective view of a divider sheet having the index tab, with the insert removed.
Figure 4:
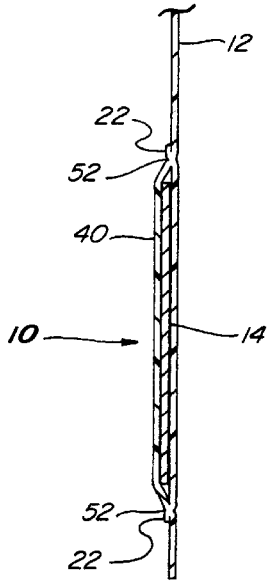
FIG. 4 is a cross-sectional view take on line 4—4 of FIG. 2.
Figure 3:
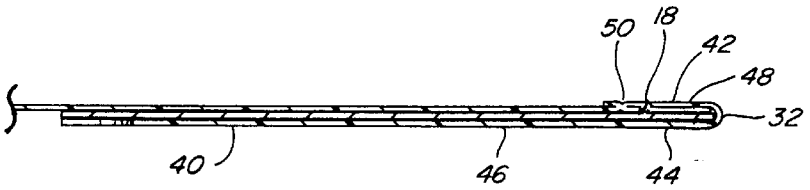
FIG. 3 is a cross-sectional view taken on line 3—3 of FIG. 2.

Referring now by reference numerals to the drawings and first to FIG. 1, it will be understood that the index tab 10 is used, as shown, on a three-ring binder divider sheet 12 and is arranged to receive an insert card 14. It will be further understood that the index tab can also be used on one panel of a file folder, which constitutes a sheet for the purpose of this description.

In the embodiment illustrated, as best shown in FIGS. 2–5 the index tab 10 is formed from a blank 20, which is generally rectangular. The blank 20 includes opposed elongate margins 22 having recessed cutout portions 24 adjacent one end margin 26 and an opposite end margin 28 having an adjacent semi-circular cutout portion 30. The blank 20 is foldable about a fold line 32 so that end margin 26 is aligned with the line 34, shown in phantom outline, in the folded condition.

In the embodiment shown, the sheet 12 and the blank 20 are both formed from heat-sealable plastic sheet material such as polyethylene, polypropylene or Mylar. As shown in FIG. 2, when the blank 20 is folded about fold line 32, the partial margins 23 may be aligned with the sheet vertical margin 18. This arrangement provides a first panel 40, associated with end margin 28, and a second panel 42, associated with end margin 26. The first, front panel 40 includes an outwardly extending portion 44 and an inwardly extending portion 46, relative to the sheet margin 18. The second, rear panel 42 overlaps the front panel 40 and includes an outwardly extending portion 48 and a relatively short inwardly extending portion 50, also relative to the sheet margin 18. The index tab front panel 46 is attached to one side of the sheet 12 by a pair of elongate heat seals 52, adjacent to margins 22, and the rear panel 42 is attached to the other side of sheet 12 by a transverse, perpendicular heat seal 54, adjacent to margin 26.

The arrangement described provides an insert-receiving pocket 60 having a first pocket portion formed from the first and second panels 40 and 42, extending from margin 28 to fold line 32, and a second pocket portion formed from the first panel 40 and the sheet 12 and extending from sheet margin 18 to the open end margin 28. The insert 14 has a width substantially equal to the distance between the recess portions 24 and a length substantially equal to the length of the pocket 60. That is to say, the insert 14 is coextensive with the pocket closed end defined by the fold line 32, and the open end defined by the end margin 28. Thus, the complete pocket 60 is formed by cooperation between the front panel 40 and the sheet 12, to which it is attached, and the front panel 40 and the rear panel 42 extending outwardly beyond the sheet margin 18.

It will be understood that this arrangement also provides open upper and lower ends 62 for the outwardly extending pocket portion of the index tab 10 which may be used to accommodate a conventional insert strip, if desired.

Although the index tab system has been described by making detailed reference to a preferred embodiment, the details of description are not to be understood as restrictive numerous variants being possible within the scope of the claims hereunto appended.

I claim as my invention:

1. An index tab assembly comprising:

a sheet having opposed sides and a margin;

an index tab attached to the sheet and including a first panel and a second panel connected to said first panel, said first and second panels cooperating to provide a first pocket portion extending outwardly of said margin and having a closed outer end, and at least said first panel extending inwardly of said margin to, at least in part, provide a second pocket portion having an insert-receiving open end, said index tab being fixedly attached to said sheet and said first pocket portion being adapted to receive an insert received by said open end of said second pocket portion, said second pocket portion communicating with said first pocket portion to provide communicating pocket portions, and an insert is provided having a length substantially coextensive with and being received within the communicating pocket portions.

* * * * *